US012808176B2

(12) United States Patent
Brown et al.

(10) Patent No.: US 12,808,176 B2
(45) Date of Patent: Nov. 24, 2026

(54) URINAL SCREENS

(71) Applicant: Fresh Products, Inc., Perrysburg, OH (US)

(72) Inventors: Douglas S. Brown, Toledo, OH (US); Jeffrey A. Smith, Perrysburg, OH (US)

(73) Assignee: Fresh Products, Inc., Perrysburg, OH (US)

( * ) Notice: Subject to any disclaimer, the term of this patent is extended or adjusted under 35 U.S.C. 154(b) by 95 days.

(21) Appl. No.: 19/049,456

(22) Filed: Feb. 10, 2025

(65) Prior Publication Data

US 2026/0009215 A1 Jan. 8, 2026

Related U.S. Application Data

(63) Continuation of application No. 18/460,438, filed on Sep. 1, 2023, now Pat. No. 12,247,381, which is a continuation of application No. 17/809,671, filed on Jun. 29, 2022, now Pat. No. 11,781,305, which is a continuation of application No. 17/643,791, filed on Dec. 10, 2021, now Pat. No. 11,396,745, which is a continuation of application No. 16/666,802, filed on Oct. 29, 2019, now Pat. No. 11,198,997, which is a continuation of application No. 16/175,379, filed on Oct. 30, 2018, now Pat. No. 10,501,924, which is a (Continued)

(51) Int. Cl.
*E03D 13/00* (2006.01)
*E03D 9/00* (2006.01)

(52) U.S. Cl.
CPC ..... *E03D 13/005* (2013.01); *E03D 9/00* (2013.01); *E03D 9/007* (2013.01)

(58) Field of Classification Search
CPC ..... E03D 13/005; E03D 9/00; E03D 9/007
See application file for complete search history.

(56) References Cited

U.S. PATENT DOCUMENTS 333,935 A 1/1886 Duncan
487,130 A 11/1892 Schoen
539,698 A 5/1895 Milligan
(Continued)

FOREIGN PATENT DOCUMENTS

CN 3680203 8/2007
CN 201649256 U 11/2010
(Continued)

OTHER PUBLICATIONS

Petitioner's Opposition to Patent Owner's Motion for Discretionary Denial, *Fresh Products, LLC* v. *Sanastar, Inc. d/b/a Wizkid Products*, IPR2025-01339, U.S. Pat. No. 10,036,154, filed Oct. 29, 2025, with exhibits, in 81 pages.

(Continued)

*Primary Examiner* — Janie M Loeppke
(74) *Attorney, Agent, or Firm* — KNOBBE, MARTENS, OLSON & BEAR, LLP

(57) ABSTRACT

A urinal screen having a frame and a plurality of protrusions extending from the frame. The frame can include a plurality of openings. The openings can be defined by a plurality of perimeter structures. The protrusions can extend from the perimeter structures. In some embodiments, protrusions extend from a first face and a second face of the frame.

10 Claims, 6 Drawing Sheets

Related U.S. Application Data continuation of application No. 14/925,369, filed on Oct. 28, 2015, now Pat. No. 10,145,098.

(60) Provisional application No. 62/075,827, filed on Nov. 5, 2014.

(56) References Cited

U.S. PATENT DOCUMENTS

| | | | |
|---|---|---|---|
| 555,888 | A | 3/1896 | Roberts |
| 557,762 | A | 4/1896 | Brockman |
| 571,275 | A | 11/1896 | Maxwell et al. |
| 639,628 | A | 12/1899 | Thomsen et al. |
| 675,947 | A | 6/1901 | Hack |
| 810,973 | A | 1/1906 | Pattenden et al. |
| 927,026 | A | 7/1909 | Clayton |
| 950,574 | A | 3/1910 | Morgan |
| 1,109,904 | A | 9/1914 | Dahlgren |
| 1,186,345 | A | 6/1916 | Sleight |
| 1,208,675 | A | 12/1916 | Sleight |
| 1,260,082 | A | 3/1918 | Sleight |
| 1,292,856 | A | 1/1919 | Niblo |
| 1,731,431 | A | 10/1929 | Meyer |
| 1,880,962 | A | 10/1932 | Koppelman |
| 1,886,676 | A | 11/1932 | Heuacker |
| 1,935,128 | A | 11/1933 | Pullman |
| 2,011,732 | A | 8/1935 | Saeks |
| 2,020,864 | A | 11/1935 | Aronson et al. |
| 2,087,592 | A | 7/1937 | Chesnut |
| 2,211,970 | A | 8/1940 | Fischer |
| 2,233,234 | A | 2/1941 | Wilson |
| 2,447,178 | A | 8/1948 | Hatchette |
| 2,506,669 | A | 5/1950 | Heuacker |
| 2,508,808 | A | 5/1950 | Warman |
| 2,679,054 | A | 5/1954 | Singleton |
| 2,690,569 | A | 10/1954 | Kozerski |
| 2,931,047 | A | 4/1960 | Stebbins |
| 2,984,841 | A | 5/1961 | Wilson |
| 3,005,209 | A | 10/1961 | Timmons |
| D194,776 | S | 3/1963 | Clark |
| D194,777 | S | 3/1963 | Clark |
| 3,170,169 | A | 2/1965 | Clark |
| 3,237,330 | A | 3/1966 | Dinstbir |
| 3,248,740 | A | 5/1966 | Wisnom |
| 3,268,920 | A | 8/1966 | Beer |
| 3,329,998 | A | 7/1967 | Stohr |
| 3,387,069 | A | 6/1968 | Stohr |
| 3,422,558 | A | 1/1969 | Fee |
| 3,540,433 | A | 11/1970 | Brockman |
| 3,559,353 | A | 2/1971 | Partridge |
| 3,597,772 | A | 8/1971 | Leavitt et al. |
| 3,599,677 | A | 8/1971 | O'Brien |
| 3,614,790 | A | 10/1971 | Billingsly et al. |
| 3,631,560 | A | 1/1972 | Atkins |
| 3,723,998 | A | 4/1973 | Wehr |
| 3,752,121 | A | 8/1973 | Brazzell |
| 3,760,429 | A | 9/1973 | Brownstein |
| 3,788,485 | A | 1/1974 | Bruning |
| 3,804,796 | A | 4/1974 | Alexandre |
| 3,824,633 | A | 7/1974 | Van Vlahakis |
| 3,837,988 | A | 9/1974 | Hennen et al. |
| 3,867,953 | A | 2/1975 | Stohr |
| 3,899,192 | A | 8/1975 | Reddaway |
| 3,923,442 | A | 12/1975 | Stohr |
| 3,935,602 | A | 2/1976 | Kale |
| 4,010,497 | A | 3/1977 | Menter et al. |
| 4,095,031 | A | 6/1978 | Engle |
| 4,103,367 | A | 8/1978 | Kaufer |
| D253,145 | S | 10/1979 | Adam |
| D255,744 | S | 7/1980 | Dekko |
| 4,212,153 | A | 7/1980 | Kydonieus et al. |
| 4,215,443 | A | 8/1980 | Babik |
| 4,230,582 | A | 10/1980 | Tuleja |
| D258,181 | S | 2/1981 | Adam |
| D258,472 | S | 3/1981 | Adam |
| 4,305,216 | A | 12/1981 | Skelton |
| 4,361,606 | A | 11/1982 | Butler et al. |
| 4,389,963 | A | 6/1983 | Pearson |
| 4,405,509 | A | 9/1983 | Rogers et al. |
| 4,408,557 | A | 10/1983 | Bradley et al. |
| 4,418,432 | A | 12/1983 | Vidal |
| 4,440,542 | A | 4/1984 | Foley |
| 4,490,862 | A | 1/1985 | Vidal |
| 4,515,909 | A | 5/1985 | Sawano et al. |
| D280,267 | S | 8/1985 | Bryant et al. |
| 4,549,693 | A | 10/1985 | Barlics |
| 4,552,693 | A | 11/1985 | Hussain et al. |
| 4,557,863 | A | 12/1985 | Callewaert et al. |
| 4,574,400 | A | 3/1986 | Annowsky |
| 4,574,403 | A | 3/1986 | Dintemann et al. |
| 4,604,357 | A | 8/1986 | Callewaert et al. |
| 4,612,676 | A | 9/1986 | Whitman |
| 4,615,926 | A | 10/1986 | Hsu et al. |
| 4,671,976 | A | 6/1987 | Vidal |
| 4,750,219 | A | 6/1988 | Williams |
| 4,761,437 | A | 8/1988 | Christie |
| 4,815,767 | A | 3/1989 | Lambert |
| 4,830,407 | A | 5/1989 | Sadler, Jr. et al. |
| 4,866,793 | A | 9/1989 | Luedtke et al. |
| 4,941,688 | A | 7/1990 | Jones |
| D312,740 | S | 12/1990 | Greenhut et al. |
| 4,985,940 | A | 1/1991 | Jones |
| 5,010,599 | A | 4/1991 | Nilsson |
| 5,019,434 | A | 5/1991 | Matsumoto |
| 5,058,088 | A | 10/1991 | Haas et al. |
| 5,058,523 | A | 10/1991 | Mikkonen et al. |
| 5,087,273 | A | 2/1992 | Ward |
| D327,534 | S | 6/1992 | Manville et al. |
| 5,117,515 | A | 6/1992 | White, Jr. et al. |
| 5,130,016 | A | 7/1992 | Gavin |
| 5,139,864 | A | 8/1992 | Lindauer |
| D329,893 | S | 9/1992 | Luedtke et al. |
| 5,150,481 | A | 9/1992 | Pang |
| 5,150,722 | A | 9/1992 | Rutherford |
| 5,165,119 | A | 11/1992 | Yamato |
| 5,188,755 | A | 2/1993 | Chang |
| D341,414 | S | 11/1993 | Baker |
| 5,309,578 | A | 5/1994 | Temple, Sr. |
| 5,313,672 | A | 5/1994 | Luedtke et al. |
| 5,336,424 | A | 8/1994 | Vlahakis et al. |
| 5,364,132 | A | 11/1994 | Haas et al. |
| 5,365,616 | A | 11/1994 | Morad |
| D353,445 | S | 12/1994 | Morad |
| 5,377,362 | A | 1/1995 | Jackson |
| D355,807 | S | 2/1995 | O'Rourke |
| 5,398,347 | A | 3/1995 | Luedtke et al. |
| D360,714 | S | 7/1995 | d'Alquen |
| 5,472,712 | A | 12/1995 | Oshlack et al. |
| 5,479,735 | A | 1/1996 | Martin, Jr. |
| 5,482,007 | A | 1/1996 | Kumlin |
| 5,489,415 | A | 2/1996 | Van Vlahakis et al. |
| 5,496,300 | A | 3/1996 | Hirsch et al. |
| D370,938 | S | 6/1996 | Roach |
| D372,515 | S | 8/1996 | Douglas |
| 5,556,685 | A | 9/1996 | Swicegood, Jr. |
| 5,580,578 | A | 12/1996 | Oshlack et al. |
| 5,604,937 | A | 2/1997 | Davenport |
| 5,639,476 | A | 6/1997 | Oshlack et al. |
| 5,660,138 | A | 8/1997 | Hirsch |
| 5,665,439 | A | 9/1997 | Andersen et al. |
| 5,719,828 | A | 2/1998 | Haas et al. |
| D393,896 | S | 4/1998 | Wagner et al. |
| 5,774,905 | A | 7/1998 | Wager et al. |
| 5,809,590 | A | 9/1998 | Williams et al. |
| 5,813,058 | A | 9/1998 | Quigley et al. |
| 5,867,848 | A | 2/1999 | Ort |
| 5,885,701 | A | 3/1999 | Berman et al. |
| 5,958,334 | A | 9/1999 | Haddon |
| 5,961,148 | A | 10/1999 | Cheng |
| D422,061 | S | 3/2000 | Lee |
| 6,055,681 | A | 5/2000 | Lyons |
| D427,295 | S | 6/2000 | Wagner |
| 6,076,222 | A | 6/2000 | Jolly |
| 6,079,975 | A | 6/2000 | Conover |
| 6,081,937 | A | 7/2000 | Whitacre |

(56) References Cited

U.S. PATENT DOCUMENTS 6,103,201 A 8/2000 Green
6,103,351 A 8/2000 Ram et al.
6,113,148 A 9/2000 Koranda et al.
D438,710 S 3/2001 Chen
6,207,236 B1 3/2001 Araki et al.
6,213,409 B1 4/2001 Warren et al.
D442,246 S 5/2001 McCabe et al.
6,244,208 B1 6/2001 Qui et al.
6,257,540 B1 7/2001 Kresch
6,265,084 B1 7/2001 Stickler
6,269,490 B1 8/2001 Suski et al.
6,279,759 B1 8/2001 Weisbach
D456,492 S 4/2002 Lourens
6,370,705 B1 4/2002 Levinson
D464,122 S 10/2002 Mangan
6,517,759 B1 2/2003 Ferenc et al.
6,640,350 B1 11/2003 Deutsch
6,698,035 B1 3/2004 Grueser
6,703,012 B1 3/2004 White
6,730,311 B2 5/2004 Maleeny et al.
6,787,210 B2 9/2004 Stickler
D497,277 S 10/2004 Ruhl et al.
6,823,533 B2 11/2004 Casari
6,862,754 B1 3/2005 DeMarco
6,920,648 B1 7/2005 Suski et al.
6,927,199 B2 8/2005 Takemura et al.
6,988,462 B1 1/2006 Zhu
D520,610 S 5/2006 Wrate
7,061,831 B2 6/2006 De La Huerga
D528,193 S 9/2006 Lee
7,127,844 B2 10/2006 Collins
7,202,201 B1 4/2007 Williams
D561,327 S 2/2008 Dejonge
7,398,565 B1 7/2008 Chou
7,413,082 B2 8/2008 Adler et al.
7,419,588 B2 9/2008 Lawson
7,434,535 B2 10/2008 Adamy
D584,863 S 1/2009 Garry et al.
7,528,102 B2 5/2009 Barthel et al.
D598,075 S 8/2009 Uhl
7,597,949 B2 10/2009 Wright
D612,914 S 3/2010 Morad
7,742,367 B2 6/2010 Haas
7,808,861 B2 10/2010 Wien
7,833,515 B2 11/2010 Corzani et al.
D630,714 S 1/2011 Dukes
7,886,958 B2 2/2011 Smith
7,904,972 B2 3/2011 Anderson
7,921,479 B2 4/2011 Hunter
7,921,583 B2 4/2011 Londino
D639,410 S 6/2011 Ramirez
7,959,694 B2 6/2011 Braunschweig et al.
8,007,707 B1 8/2011 Brown
8,043,498 B2 10/2011 Rueda
D678,482 S 3/2013 Williams
D678,483 S 3/2013 Barker
D682,398 S 5/2013 Lee
D687,524 S 8/2013 Heiser
D687,525 S 8/2013 Heiser
D703,409 S 4/2014 Robbins, III et al.
8,856,977 B2 10/2014 Ramirez
D730,493 S 5/2015 Sehl
9,243,394 B2 1/2016 Brown et al.
9,303,396 B1 4/2016 Pernici
9,334,641 B2 5/2016 Kobal
D778,411 S 2/2017 Brown et al.
D778,412 S 2/2017 Brown et al.
D778,423 S 2/2017 Buzanowski et al.
D790,042 S 6/2017 Ramirez
D805,613 S 12/2017 D'Amico et al.
D806,835 S 1/2018 D'Amico et al.
D806,836 S 1/2018 D'Amico et al.
D806,837 S 1/2018 D'Amico et al.
D824,495 S 7/2018 D'Amico et al.
D824,496 S 7/2018 D'Amico et al.
10,036,154 B2 7/2018 Crevier
10,087,612 B2 10/2018 Brown et al.
10,145,098 B2 12/2018 Brown et al.
D838,818 S 1/2019 Malesky et al.
D841,359 S 2/2019 Crevier
10,267,027 B2 4/2019 D'Amico et al.
10,294,649 B2 5/2019 Crevier
D857,181 S 8/2019 Brown
10,501,924 B2 12/2019 Brown et al.
D873,974 S 1/2020 Helton
D874,617 S 2/2020 Chen
D875,896 S 2/2020 Dukes et al.
10,612,226 B2 4/2020 Hurd et al.
10,640,959 B2 5/2020 Malesky et al.
D893,682 S 8/2020 McDanal et al.
D920,485 S 5/2021 Crevier
D925,009 S 7/2021 Brown et al.
11,198,997 B2 12/2021 Brown et al.
D956,936 S 7/2022 Kim
11,396,745 B2 7/2022 Brown et al.
D960,329 S 8/2022 Brown et al.
11,505,935 B2 11/2022 Crevier
11,585,078 B2 2/2023 Brown et al.
11,781,305 B2 10/2023 Brown et al.
D1,016,991 S 3/2024 Kuipers
D1,017,774 S 3/2024 Chen
D1,039,121 S 8/2024 Brown et al.
D1,045,032 S 10/2024 Helton
12,139,900 B2 11/2024 Brown et al.
D1,060,616 S 2/2025 Chen
D1,061,821 S 2/2025 Chen
D1,061,822 S 2/2025 Chen
12,247,381 B2 3/2025 Brown et al.
D1,074,942 S 5/2025 Depoti et al.
D1,078,945 S 6/2025 Brown et al.
12,352,031 B2 7/2025 Crevier
D1,107,871 S 12/2025 Brown et al.
D1,121,787 S 4/2026 Brown et al.
2002/0037385 A1 3/2002 Pignot et al.
2003/0044326 A1 3/2003 Yamasaki et al.
2005/0022298 A1 2/2005 de Leon et al.
2005/0067106 A1 3/2005 Melges
2005/0112339 A1 5/2005 Sandel et al.
2005/0133516 A1 6/2005 Dyer
2005/0144711 A1 7/2005 Valadez et al.
2005/0169793 A1 8/2005 Wheatley et al.
2005/0245671 A1 11/2005 Moon et al.
2005/0283892 A1 12/2005 Simeone et al.
2006/0232059 A1* 10/2006 Fortune ..... E03D 13/005 374/E11.018
2006/0260032 A1 11/2006 Smartt
2007/0023539 A1 2/2007 Brown et al.
2007/0039089 A1 2/2007 Worrel
2007/0044221 A1 3/2007 Wise
2007/0161927 A1 7/2007 Daugirdas
2007/0186337 A1 8/2007 Emr
2007/0266486 A1 11/2007 Ramirez
2007/0286984 A1 12/2007 Wright
2008/0098505 A1 5/2008 Casari
2008/0100057 A1 5/2008 MacPhee
2008/0292509 A1 11/2008 D'Amico
2009/0070923 A1 3/2009 Ruedas
2009/0229511 A1 9/2009 Campbell et al.
2009/0255053 A1 10/2009 Cutrone, III
2010/0183694 A1 7/2010 Burke et al.
2010/0257664 A1 10/2010 Kener
2011/0296597 A1 12/2011 Brown
2014/0007336 A1 1/2014 Mills et al.
2014/0075663 A1 3/2014 Irwin et al.
2014/0076991 A1* 3/2014 Irwin ..... A61L 2/00 4/228.1
2014/0157501 A1 6/2014 D'Amico
2014/0259344 A1* 9/2014 Muderlak ..... E03D 13/007 4/256.1
2015/0047114 A1 2/2015 Ramirez
2016/0023388 A1 1/2016 Jacob et al.
2016/0102451 A1 4/2016 Brown et al.
2016/0122992 A1 5/2016 Brown et al.
2017/0067243 A1 3/2017 Valencia Garcia

(56) References Cited

U.S. PATENT DOCUMENTS

| | | | |
|---|---|---|---|
| 2017/0096808 | A1 | 4/2017 | D'Amico et al. |
| 2018/0023278 | A1 | 1/2018 | Brown et al. |
| 2018/0080210 | A1 | 3/2018 | Hurd et al. |
| 2018/0119403 | A1 | 5/2018 | Crevier |
| 2018/0347161 | A1 | 12/2018 | Malesky et al. |
| 2019/0145088 | A1 | 5/2019 | Keune |
| 2019/0292764 | A1 | 9/2019 | Crevier |
| 2021/0238838 | A1 | 8/2021 | Crevier |
| 2022/0412066 | A1 | 12/2022 | Dalton |
| 2024/0011273 | A1 | 1/2024 | Brown et al. |

FOREIGN PATENT DOCUMENTS

| | | | |
|---|---|---|---|
| CN | 103321290 | | 9/2013 |
| CN | 203296150 | U | 11/2013 |
| CN | 203458322 | | 3/2014 |
| CN | 203905131 | U | 10/2014 |
| CN | 206346295 | U | 7/2017 |
| DE | 1915249 | A1 | 10/1970 |
| DE | 19541911 | A1 | 5/1997 |
| DE | 102012005147 | A1 | 9/2013 |
| EP | 0153946 | A1 | 9/1985 |
| EP | 3081705 | A1 | 10/2016 |
| EP | 3202990 | | 8/2017 |
| FR | 2618173 | | 1/1989 |
| FR | 2681232 | A1 | 3/1993 |
| GB | 189518394 | A | 8/1896 |
| GB | 350854 | A | 6/1931 |
| GB | 2092216 | | 8/2000 |
| GB | 2431101 | A | 4/2007 |
| GB | 2473273 | A | 3/2011 |
| GB | 2472377 | | 9/2011 |
| JP | 57-17599 | | 1/1982 |
| JP | 60-178497 | | 11/1985 |
| JP | 60-190865 | | 12/1985 |
| JP | 63-116585 | | 7/1988 |
| JP | 1990-102625 | A | 4/1990 |
| JP | 1992-119880 | U | 10/1992 |
| JP | 2001-303642 | | 10/2001 |
| JP | 2017-186861 | | 10/2017 |
| KR | 100351178 | | 5/2002 |
| KR | 20-0337763 | | 1/2004 |
| KR | 20-0351953 | Y1 | 5/2004 |
| KR | 0368846 | U | 11/2004 |
| KR | 20-0395055 | Y1 | 9/2005 |
| TR | 2015-14932 | U | 1/2016 |
| WO | WO 98/30621 | A1 | 7/1998 |
| WO | WO 2005/093177 | | 10/2005 |
| WO | WO 2014/043725 | A1 | 3/2014 |
| WO | WO 2015/088303 | | 6/2015 |
| WO | WO 2016/060998 | A1 | 4/2016 |
| WO | WO 2016/144153 | | 9/2016 |
| WO | WO 2019/126217 | A1 | 6/2019 |

OTHER PUBLICATIONS

Patent Owner's Preliminary Response, *Fresh Products, LLC* v. *Sanastar, Inc. d/b/a/ Wizkid Products*, IPR2025-01339, U.S. Pat. No. 10,036,154, filed Oct. 23, 2025, in 52 pages.

Patent Owner's Motion for Discretionary Denial Under 35 U.S.C. § 314(a), *Fresh Products, LLC* v. *Sanastar, Inc. d/b/a/ Wizkid Products*, IPR2025-01339, U.S. Pat. No. 10,036,154 and IPR2025-01366, U.S. Pat. No. 10,294,649, filed Sep. 23, 2025, with exhibits, in 282 pages.

Petitioner's Opposition to Patent Owner's Motion for Discretionary Denial, *Fresh Products, LLC* v. *Sanastar, Inc. d/b/a Wizkid Products*, IPR2025-01366, U.S. Pat. No. 10,294,649, dated Oct. 29, 2025, with exhibits, in 81 pages.

Patent Owner's Preliminary Response, *Fresh Products, LLC* v. *Sanastar, Inc., d/b/a Wizkid Products*, IPR2025-01366, U.S. Pat. No. 10,294,649, dated Oct. 31, 2025, 52 pages.

Patent Owner's Amended Motion for Discretionary Denial Under 35 U.S.C. § 314(a), *Fresh Products, LLC* v. *Sanastar, Inc. d/b/a Wizkid Products*, IPR2025-01366, U.S. Pat. No. 10,294,649, dated Sep. 29, 2025, with exhibits, in 278 pages.

Notice of Decisions on Institution, *Fresh Products, LLC* v. *Sanastar, Inc. d/b/a/ Wizkid Products*, IPR2025-01339, U.S. Pat. No. 10,036,154, and *Fresh Products, LLC* v. *Sanastar, Inc., d/b/a Wizkid Products*, IPR2025-01366, U.S. Pat. No. 10,294,649, dated Nov. 20, 2025, 2 pages.

Claim Construction Order, *Vectair Systems Inc.*, v. *Fresh Products, Inc.*, Case No. 24-cv-01454, dated Mar. 9, 2026, in 78 pages.

Order of Dismissal, *Vectair Systems Inc.*, v. *Fresh Products, Inc.*, Case No. 24-cv-01454, dated Jun. 3, 2026, in 2 pages.

Order Approving Stipulation of Dismissal with Prejudice, *Sanastar Inc., d/b/a Wizkid Products* v. *Fresh Products LLC*, Civil Action No. 3:25-cv-00418-JZ, dated Jun. 4, 2026, in 2 pages.

Plaintiff Fresh Products, Inc., Complaint for Patent Infringement Demand for Jury Trial, Case No. 2:19-cv-05994, filed Jul. 11, 2019.

Defendant Impact Products, LLC, Answer and Affirmative Defenses Demand For Jury Trial, Case No. 2:19-cv-05994 GW(AFMx), filed Sep. 4, 2019.

Fresh Products, Inc.'s First Amended Complaint, Case No. 3:19-cv-02109-JZ, with Exhibits, filed Feb. 4, 2020 in 55 pages.

Defendant Impact Products, LLC's Answer and Affirmative Defenses to First Amended Complaint, Case No. 3:19-cv-02109-JZ, filed Feb. 18, 2020 in 9 pages.

Defendant Impact Products, LLC, Invalidity Contentions, Demand For Jury Trial, Case No. 3:19-cv-02109-JZ, with Exhibits, filed Apr. 8, 2020 in 813 pages.

Fresh Products, Inc.'s Opening Claim Construction Brief, Case No. 3:19-cv-02109-JZ, filed Aug. 4, 2020 in 30 pages.

Defendant Impact Products, LLC's Opening Claim Construction Brief, Case No. 3:19-cv-02109-JZ, with Exhibits, filed Aug. 4, 2020 in 370 pages.

Defendant Impact Products, LLC's Responsive Claim Construction Brief, Case No. 3:19-cv-02109-JZ, with exhibits, dated Sep. 3, 2020.

Fresh Products, Inc.'s Responsive Claim Construction Brief, Case No. 3:19-cv-02109-JZ, dated Sep. 3, 2020.

Joint Claim Construction and Prehearing Statement, Case No. 3:19-cv-02109-JZ, dated Sep. 8, 2020.

Joint Notice of Additional Agreed-Upon Claim Constructions, Case No. 3:19-cv-02109-JZ, dated Oct. 28, 2020.

Transcript of Video Claim Construction Hearing Proceedings Before the Honorable Jack Zouhary, United States Senior District Judge, Case No. 3:19-CV-2109, dated Nov. 16, 2020.

Joint Notice of Additional Agreed-Upon Claim Constructions, Case No. 3:19-cv-02109-JZ, dated Nov. 17, 2020.

Markman Order, Case No. 3:19-cv-02109-JZ, dated Nov. 24, 2020.

Dismissal and Order re Validity and Enforceability, Case No. 3:19-cv-02109-JZ, dated Feb. 3, 2021.

Non-Infringement and Invalidity Contentions [with Exhibits 1-7], Case No. CIV-21-00211-F, dated Aug. 20, 2021.

Order Regarding Claim Construction, *Big D Industries, Inc.*, v. *Fresh Products, Inc.*, Case No. 5:21-cv-00211-F, May 6, 2022.

Order Regarding Claim Construction, *Big D Industries, Inc.*, v. *Fresh Products, Inc.*, Case No. 5:21-cv-00211-F, Apr. 5, 2022.

Complaint, *Big D Industries, Inc.*, v. *Fresh Products, Inc.*, Case No. 5:22-cv-00182-PRW, Mar. 2, 2022.

Fresh Products Final Infringement Contentions, *Big D Industries, Inc.*, v. *Fresh Products, Inc.*, Case No. 5:21-cv-00211-F, Jun. 15, 2022.

Expert Report of Nathan J. Macdonald, Case No. CIV-21-211-F, Oct. 21, 2022.

Expert Report of Randy Hurd, PH.D., Case No. 5:21-cv-00211-F, Sep. 23, 2022.

Fresh Products, Inc.'s Answer to Complaint and Counterclaim, Case No. 0:24-cv-01454-JMB-ECW, May 9, 2024.

Complaint for Declaratory Judgement of Invalidity and Noninfringement, *Vectair Systems Inc.* v. *Fresh Products, Inc.*, Case No. 0:24-cv-01454-JMB-ECW, Apr. 20, 2024, with exhibits.

Petition for Inter Partes Review of U.S. Pat. No. 10,145,098, *Vectair Systems Inc.* v. *Fresh Products, Inc.*, Apr. 19, 2024, with exhibits.

(56) References Cited

OTHER PUBLICATIONS

Vectair's Answer to Fresh Products, Inc.'s First Amended Counterclaim, Case No. 0:24-cv-01454-JMB- ECW, Jun. 13, 2024, in 26 pages.
Patent Owner Preliminary Response, *Vectair Systems Inc.*, Petitioner, v. *Fresh Products, Inc.*, Patent Owner, Case No. IPR2024-00824, U.S. Pat. No. 10,145,098, dated Aug. 13, 2024, in 49 pages.
Vectair Systems Inc.'s Invalidity Contentions, *Vectair Systems Inc.*, Plaintiff and Counterclaim Defendant, v. *Fresh Products, Inc.*, Defendant and Counterclaimant, Civil No. 0:24-cv-01454-JMB-ECW, dated Aug. 24, 2024, in 829 pages.
Fresh Products, Inc.'s Answer to Complaint and First Amended Counterclaim, *Vectair Systems Inc.*, Plaintiff, v. *FreshProducts, Inc.*, Defendant, *Fresh Products, Inc*. Counter-Claimant, v. *Vectair Systems Inc.*, Counter-Defendant, Case No. 0:24-cv-01454-JMB-ECW, filed on May 30, 2024, in 119 pages.
Fresh Products, Inc.'s Answer to "Vectair's Additional Counterclaim", Case No. 0:24-cv-01454-JMB-ECW, filed on Jul. 3, 2024, in 12 pages.
Fresh Products, Inc.'s Response to Vectair Systems Inc.'s Invalidity Contentions, *Vectair Systems Inc.*, Plaintiff, v. *Fresh Products, Inc.*, Defendant, Civil Action No. 0:24-cv-01454-JMB-ECW, dated Sep. 30, 2024, in 408 pages.
Joint Claim Construction Statement, *Vectair Systems Inc*. v. *Fresh Products, Inc. and Fresh Products, inc*. v. *Vectair Systems, Inc.*, Civil Action No. 0:24-cv-01454-JMG-ECW, dated Dec. 11, 2024, in 44 pages.
Decision Denying Institution of Inter Partes Review, *Vectair Systems, Inc*. v. *FreshProducts, inc.*, PR2024-00824, U.S. Pat. No. 10,145,098, dated Nov. 12, 2024, in 24 pages.
Declaration of Sean Stewart, dated Mar. 23, 2022, with exhibits, in 30 pages.
Fresh Products, Inc., The Wave 2.0 Flyer, in 1 page.
Big D Product Catalog, Jan. 2013, in 16 pages.
Dugdale, David C., "Uroflowmetry" MedlinePlus Medical Encyclopedia, 2008. http://www.nlm.nih.gov/medlineplus/ency/article/003325.htm, retrieved on Oct. 28, 2014, 2 pages.
Fresh Products Tidal Wave Urinal Screen, YouTube Video Frame 0: 19/1 :23, Publish Date Sep. 20, 2017, Visited Online May 26, 2020, https://www.youtube.com/watch?v=G_g2_ 1NtE2l&feature=emb_logo (Year: 2017).
Fresh Products 3WDS60SAP Wave 3-D Urinal Deodorizer Screen, Red; Spiced Apple Fragrance; indicated as first available date May 10, 2013; visited online Feb. 5, 22; https://www.amazon.com/Fresh-Products-3WDS60SAP-Deodorizer-Fragrance/dp/B00MX5A9ME/ref=pd_Ipo_2?pd_rd_i=B00MX5A9ME&psc=1.
Fresh Products Wave 3-D Urinal Screen, Herbal Mint; indicated as first available date Sep. 3, 2014; visited online Feb. 5, 22; https://www.amazon.com/Fresh-Products-Urinal-Screen-Herbal/dp/B00NA58YGE.
Gray, Henry. "The Male Urethra". Anatomy of the Human Body, 3b. 4, 1918. http://www.bartleby.com/107/256.html, retrieved on Oct. 27, 2014. 5 pages.
Ritter, R. C. et al., "Analysis of Drop Intervals in Jets Modelling Obstruction of the Urinary Tract," Physics in Medicine and Biology, 1974, vol. 19, No. 2, 161-170, 11 pages.
Ritter, R. C. et al., "Physical Information in the External Urinary Stream of the Normal and Obstructed Adult Male, " British Journal of Urology, 1977, vol. 49, 293-302, 10 pages.
Fresh Products Slant7 urinal screen, best splash prevention, easy installation, long-lasting fragrance—fabulous, purple, made in USA, lasts for 30 days, 10pk urinal screens, available in Amazon.com, date first available Aug. 7, 2020, site visited Jul. 19, 2023, https://www.amazon.com/Fresh-Products-Prevention-Installation-Long-Lasting/dp/B08FF94W2B (2020).
The Pearl 3D® urinal screen product cut sheet, and 3D renderings of The Pearl 3D urinal screen product, in three pages. The cut sheet includes a date of Sep. 2013; however, Applicant makes no representations as to the accuracy of this date. Applicant further makes no representation as towhether the 3D renderings accurately represent the product shown in the cut sheet and as to whether the 3D renderings accurately represent any prior art product. Applicant requests that the Examiner review the reference as prior art. Applicant reserves the right to disqualify the reference as prior art if needed.
*Complaint, Sanastar Inc., d/b/a Wizkid Products* v. *Fresh Products LLC*, Case No. 25-cv-00418, filed Mar. 3, 2025, in 139 pages.
Plaintiff's Vectair System Inc.'s Motion to Streamline the Number of Asserted Claims, *Vectair Systems Inc*. v. *Fresh Products, Inc.*, case No. 0:24-cv-01454-JMB-ECW, dated Mar. 24, 2025, in 13 pages.
Vectair Systems Inc.'s Opening Claim Construction Brief, *Vectair Systems Inc*. v. *Fresh Products, Inc.*, Civil Action No. 0:24-cv-01454-JMG-ECW, dated Apr. 29, 2025, with exhibits, redacted version, in 137 pages.
Fresh Products, Inc.'s Opening Claim Construction Brief, *Vectair Systems Inc*. v. *Fresh Products, Inc.*, Civil Action No. 0:24-cv-01454-JMG-ECW, dated Apr. 29, 2025, with exhibits, in 213 pages.
Fresh Products LLC's Answer to Complaint and Counterclaims, *Sanastar Inc., d/b/a Wizkid Products* v. *Fresh Products LLC and Fresh Products LLC* v. *Sanastar Inc., d/b/a Wizkid Products*, Civil Action No. 3:25-cv-00418-JZ, filed Apr. 30, 2025, in 17 pages.
Vectair Systems Inc.'s Responsive Claim Construction Brief, *Vectair Systems Inc*. v. *Fresh Products, Inc.*, Civil Action No. 0:24-cv-01454-JMG-ECW, dated May 20, 2025, with exhibits, in 62 pages.
Fresh Products, Inc.'s Responsive Claim Construction Brief, *Vectair Systems Inc*. v. *Fresh Products, Inc.*, Civil Action No. 0:24-cv-01454-JMG-ECW, dated May 20, 2025, with exhibits, redacted version, in 90 pages.
Petition for Inter Partes Review of U.S. Pat. No. 10,294,649, filed Jul. 31, 2025, *Fresh Products, LLC* v. *Sanastar, Inc. d/b/a Wizkid Products*, IPR2025-01366, with exhibits.
Petition for Inter Partes Review of U.S. Pat. No. 10,036,154, filed Jul. 23, 2025, *Fresh Products, LLC* v. *Sanastar, Inc. d/b/a Wizkid Products*, IPR2025-01339, with exhibits.
Declaration of Randy Hurd, Ph. D., in Support of Fresh Products, Inc.'s Responsive Claim Construction Brief, *Vectair Systems Inc*. v. *Fresh Products, Inc.*, Civil Action No. 0:24-cv-01454-JMG-ECW, dated May 20, 2025, in 32 pages.
British Plastics Federation, Ethylene Vinyl Acetate (EVA), accessed on Sep. 23, 2025, at: https://www.bpf.co.uk/plastipedia/polymers/EVA.aspx, in 3 pages (2025).
Kota et al., "Designing compliant mechanisms", Mechanical Engineering, vol. 117(11):93-97 (1995).
Fresh Products Wave 3D Urinal Screen Sep. 3, 2014 found on Jan. 29, 2025 at https://www.amazon.com/Fresh-Products-Urinal-Screen-Blossom/dp/B00NA58VAI?th=1 (2014).

* cited by examiner

URINAL SCREENS

CROSS REFERENCE TO RELATED APPLICATIONS

Any and all applications for which a foreign or domestic priority claims is identified in the Application Data Sheet as filed with the present application are hereby incorporated by reference under 37 CFR 1.57.

TECHNICAL FIELD

Certain embodiments discussed herein relate to restroom screens and mats, and, more particularly, the present inventions relate to restroom urinal screens and mats.

DISCUSSION OF THE RELATED ART

Urinal screens are widely used as air fresheners and to prevent debris from being flushed down a urinal drain. In some cases, a fragrance is provided with the screens to help sanitize and freshen the air in and around the urinal.

SUMMARY OF THE INVENTIONS

A urinal screen can include a frame. In some embodiments, the frame has a first face and a second face opposite the first face. The frame can include a plurality of openings extending through the first face and the second face. In some cases, the screen includes a plurality of first posts extending from the first face of the frame. The screen can include a plurality of second posts extending from the second face of the frame.

According to some variants, the portion of the frame defining each of the openings has a polygonal perimeter structure. In some embodiments, each perimeter structure defining an opening has a plurality of braces and corners. In some cases, a plurality of the braces and corners are shared between two or more openings. In some embodiments, the braces and corners form a tessellation. According to some variants, each of plurality of first posts extends from the portion of the frame defining a corner of a perimeter structure forming one or more of the plurality of openings. In some cases, each of plurality of second posts extends from a midpoint of a brace of a portion of the frame defining a perimeter structure forming one or more of the plurality of openings. In some embodiments, at least one of the plurality of second posts extends from each of the braces of the perimeter structure defining the openings. In some cases, at least one of the plurality of first posts extends from each of the corners of the perimeter structure defining the openings. In some embodiments, at least one of the plurality of second posts extends from each of the braces of the perimeter structure defining the openings and at least one of the plurality of first posts extends from each of the corners of the perimeter structure defining the openings. According to some variants, at least one of the plurality of second posts extends from a brace or corner of the portion of the perimeter structure defining each opening. In some embodiments, at least one of the plurality of first posts extends from a brace of the perimeter structure defining each opening or corner of the perimeter structure defining each opening. In some cases, each of the plurality of first posts is substantially identical to one or more of the plurality of second posts.

According to some variants, a thickness of the frame in a direction perpendicular to the first face of the frame is less than one fourth of an overall thickness of the urinal screen in the direction perpendicular to the first face of the frame. In some cases, a thickness of the frame in a direction perpendicular to the first face of the frame is less than one eighth of an overall thickness of the urinal screen in the direction perpendicular to the first face of the frame. In some embodiments, when the urinal screen is set upon a surface such that the first or second face of the frame is oriented toward the surface, the frame is positioned away from the surface by at least one third of a thickness of the urinal screen as measured perpendicular to the first face of the frame. In some cases, the plurality of openings occupy at least three fourths of a surface area of the frame as measured parallel to the first face (e.g., the first plane) of the frame. In some embodiments, the perimeter structures defining the plurality of openings occupy less than one fifth of a surface area of the frame as measured parallel to the first face (e.g., the first plane) of the frame.

According to some variants, a urinal screen includes a frame. The frame can have: a first face; a second face opposite the first face; and a plurality of openings extending through the frame between the first face and the second face. The urinal screen can include a plurality of first posts extending from the first face of the frame. In some embodiments, the urinal screen includes a plurality of second posts extending from the second face of the frame. In some embodiments, a plurality of ends of the plurality of second posts form a base upon which the urinal screen rests when the plurality of first posts point away from a surface upon which the urinal screen is set. In some embodiments, at least half of the plurality of first posts are a same size and shape as at least half of the plurality of second posts.

In some configurations, each of the openings is defined by a polygonal perimeter structure.

In some configurations, each opening is defined by a perimeter structure having plurality of braces and corners.

In some configurations, each of plurality of first posts extends from a corner of a perimeter structure of one or more of the plurality of openings.

In some configurations, each of plurality of second posts extends from a midpoint of a brace of a perimeter structure of one or more of the plurality of openings.

In some configurations, at least one of the plurality of second posts extends from each of the braces of the perimeter structure defining the openings.

In some configurations, at least one of the plurality of first posts extends from each of the corners of the perimeter structure defining the openings.

In some configurations, at least one of the plurality of second posts extends from each of the braces of the openings. In some configurations, at least one of the plurality of first posts extends from each of the corners of the perimeter structure defining the openings.

In some configurations, at least one of the plurality of second posts extends from a brace or corner of the perimeter structure defining each opening.

In some configurations, at least one of the plurality of first posts extends from a brace or corner of the perimeter structure defining each opening.

In some configurations, a thickness of the frame in a direction perpendicular to the first face of the frame is less than one eighth of an overall thickness of the urinal screen in the direction perpendicular to the first face of the frame.

In some configurations, when the urinal screen is set upon a surface such that the first or second face of the frame is oriented toward the surface, the frame is positioned away from the surface by at least one third of a thickness of the urinal screen as measured perpendicular to the first face of the frame.

According to some variants, a urinal screen includes a frame. The frame can have: a first face; a second face opposite the first face; and a plurality of openings extending through the frame between the first face and the second face. In some embodiments, the urinal screen includes a plurality of first posts extending from the first face of the frame. The urinal screen can include a plurality of second posts extending from the second face of the frame. In some embodiments, the plurality of openings occupy at least half of a surface area of the frame as observed perpendicular to the first face of the frame when the frame is set on a flat surface. In some case, the plurality of openings occupy at least 75% of the surface area of the frame as observed perpendicular to the first face of the frame when the frame is set on a flat surface.

In some configurations, each of the plurality of first posts is substantially identical to one or more of the plurality of second posts.

In some configurations, the perimeter structures of the plurality of openings occupy less than one fifth of a surface area of the frame as measured parallel to a first plane face of the frame, wherein the first plane face of the frame is a plane passing through the frame when the frame is set on a flat horizontal surface.

According to some variants, a urinal screen includes a frame. The frame can include: a first face; a second face opposite the first face; and a plurality of interconnected cells, each cell having a polygonal shape with a plurality of sides and corners. In some embodiments, the urinal screen includes a plurality of first posts extending from away from the first face, each of the plurality of first posts connected to a side or corner of the plurality of interconnected cells. In some embodiments, the urinal screen include a plurality of second posts extending away from the second face of the frame, each of the plurality of second posts connected to a side or corner of the plurality of interconnected cells. In some cases each of the interconnected cells shares at least one side and at least one corner with another interconnected cell.

In some configurations, the plurality of interconnected cells form a tessellation.

In some configurations, a thickness of the frame in a direction perpendicular to the first face of the frame is less than one fourth of an overall thickness of the urinal screen in the direction perpendicular to the first face of the frame.

BRIEF DESCRIPTION OF THE DRAWINGS

The present inventions are described with reference to the accompanying drawings, in which like reference characters reference like elements, and wherein.

DETAILED DESCRIPTION OF THE INVENTIONS

Figure 1:
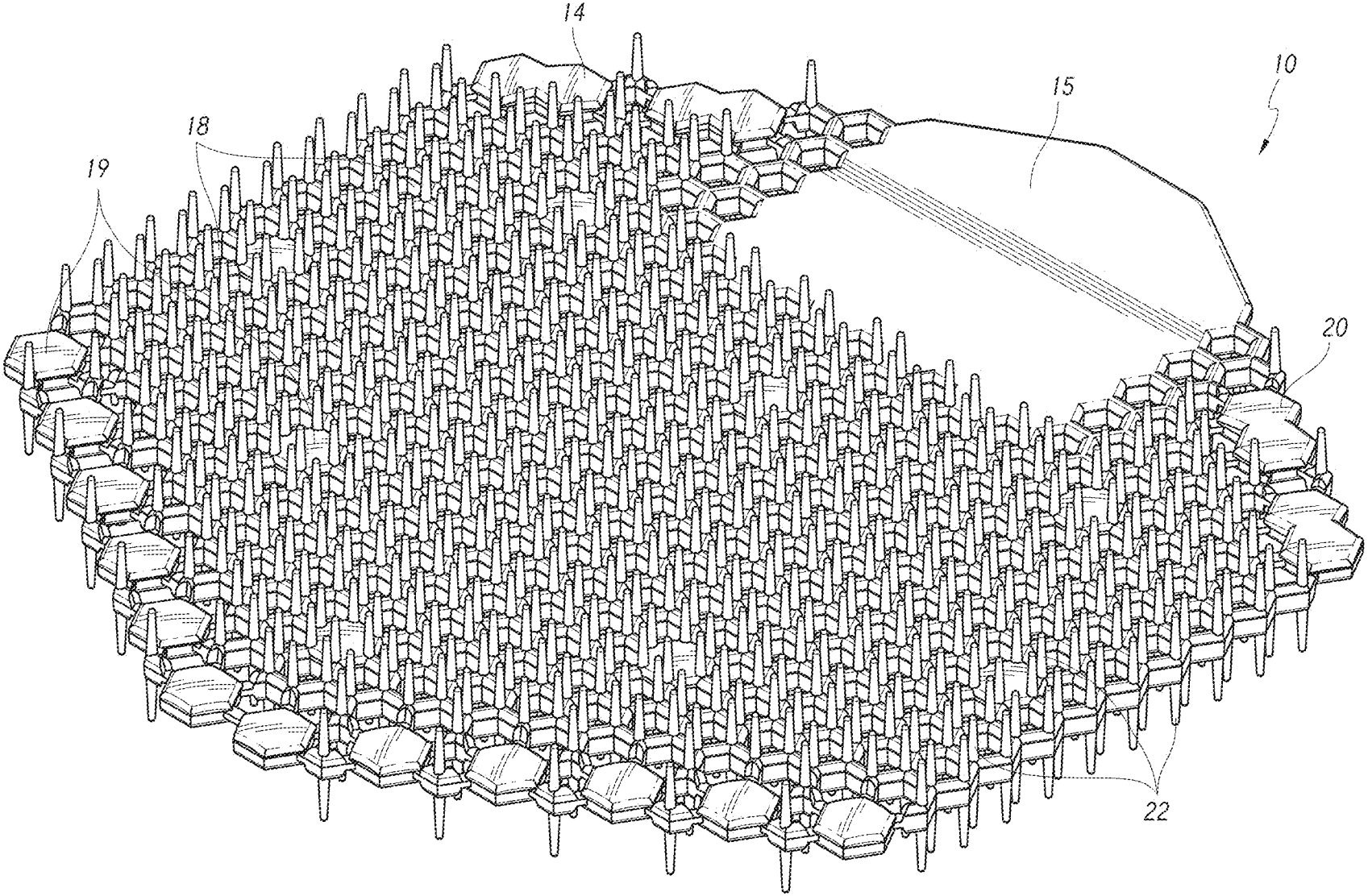
FIG. 1 is a perspective view of an embodiment of a urinal screen.
Figure 2:
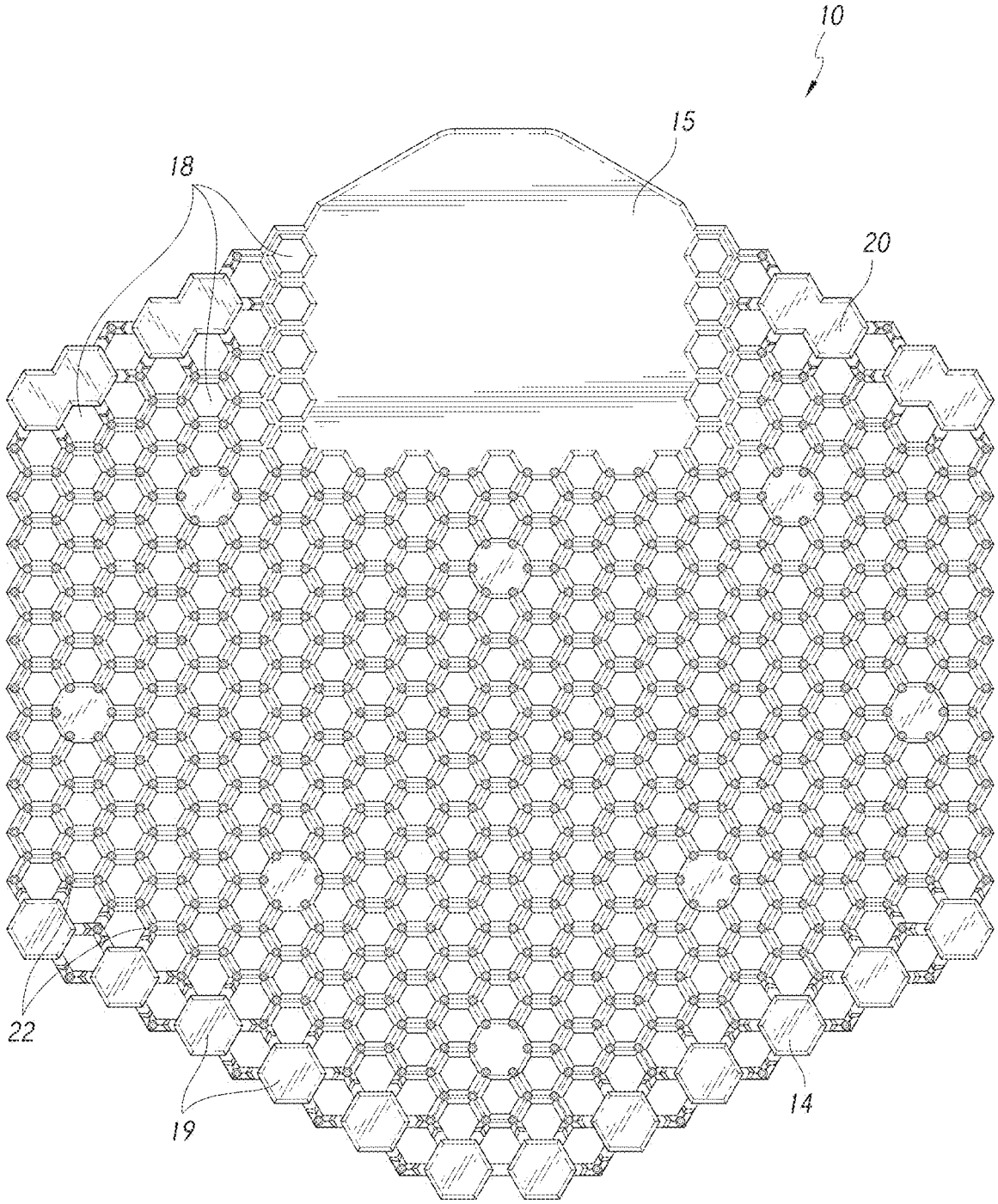
FIG. 2 is a top view of the urinal screen of FIG. 1.

An embodiment of a urinal screen 10 is illustrated in FIGS. 1-2. The urinal screen 10 can be sized and shaped to fit into a urinal, toilet, or other bathroom appliance. As illustrated, the urinal screen 10 can include a frame 14. The frame 14 can be sized and shaped to fit over all or a portion of a drain of a toilet or urinal. The frame 14 can define a plurality of openings 18 through a thickness of the frame 14. In some embodiments, the urinal screen 10 includes a plurality of posts or structural supports 22 extending from one or more surfaces of the frame 14.

In some embodiments, the screen 10 has a polygonal, elliptical, circular, or other overall shape. For example, as illustrated in FIG. 2, the screen 10 can have a generally hexagonal shape, though many other shapes are contemplated (e.g., rectangles, pentagons, triangles, circles, or some combination thereof). In some embodiments, the screen 10 is shaped to fit a particular urinal or toilet.

The frame 14 and/or posts 22 can be constructed from a polymeric or solid material. For example, the frame 14 and/or posts 22 can be constructed using a 3D printer. In some cases, additives are added to the material of the frame 14 and/or posts 22. Additives can include, for example, bacteria and/or odor neutralizers, silver ions, and other additives or combinations of additives. One method of manufacturing an embodiment of the urinal screen 10 can include providing plastic or EVA material, which may have a melting point of not greater than 250° F., loading the plastic or EVA with at least 15% to about 75% by weight of fragrance material to produce a fragranced plastic or EVA, loading the fragrance at a stage conducted at temperatures such that the fragranced plastic or EVA is from at least 15% by weight fragrance upon completion of the loading stage, and molding the fragranced plastic or EVA into a urinal screen, sized and shaped to be disposed in a urinal, forming openings 18 in the frame 14, and forming posts 22 extending from the frame 14.

The openings 18 can have various shapes, including, but not limited to, polygons (e.g., triangles, rectangles, pentagons, hexagons, etc.), ellipses, and/or some combination thereof. In some embodiments, each of the openings 18 has a substantially identical shape. In some embodiments, one or more of the openings 18 has a different shape from one or more of the other openings.

The openings 18 can occupy a large percentage of the overall surface area of the frame 14 as viewed in FIG. 2. For example, the openings 18 can occupy more than ⅛, more than ⅔, more than ⅓, more than ¼, more than ⅜, more than ½, more than ⅝, more than ⅔, and/or more than ¾ of the overall surface area of the frame 14 as viewed in FIG. 2. Utilizing a large number of openings 18 can reduce the overall weight of the urinal screen 10.

A top surface (e.g., the first surface 26) of the frame 14 can lie on a first plane when the urinal screen 10 is set on a flat surface. In some cases, a bottom surface (e.g., the second surface 30) of the frame 14 can lie on a second plane when the urinal screen is set on a flat surface. In some embodiments, a maximum cross-sectional area of the frame 14 (e.g., the area not occupied by openings 18), as measured on a frame plane through the frame and parallel to the first and/or second planes is less than ½, less than ¼, less than ⅕, less than ⅙, less than ⅐, less than ⅛, less than ⅙, less than 1/10, less than 1/12, less than 1/15, and/or less than 1/20 of the area defined by the outer perimeter of the frame as measured in the plane. Many variations are possible.

Figure 3:
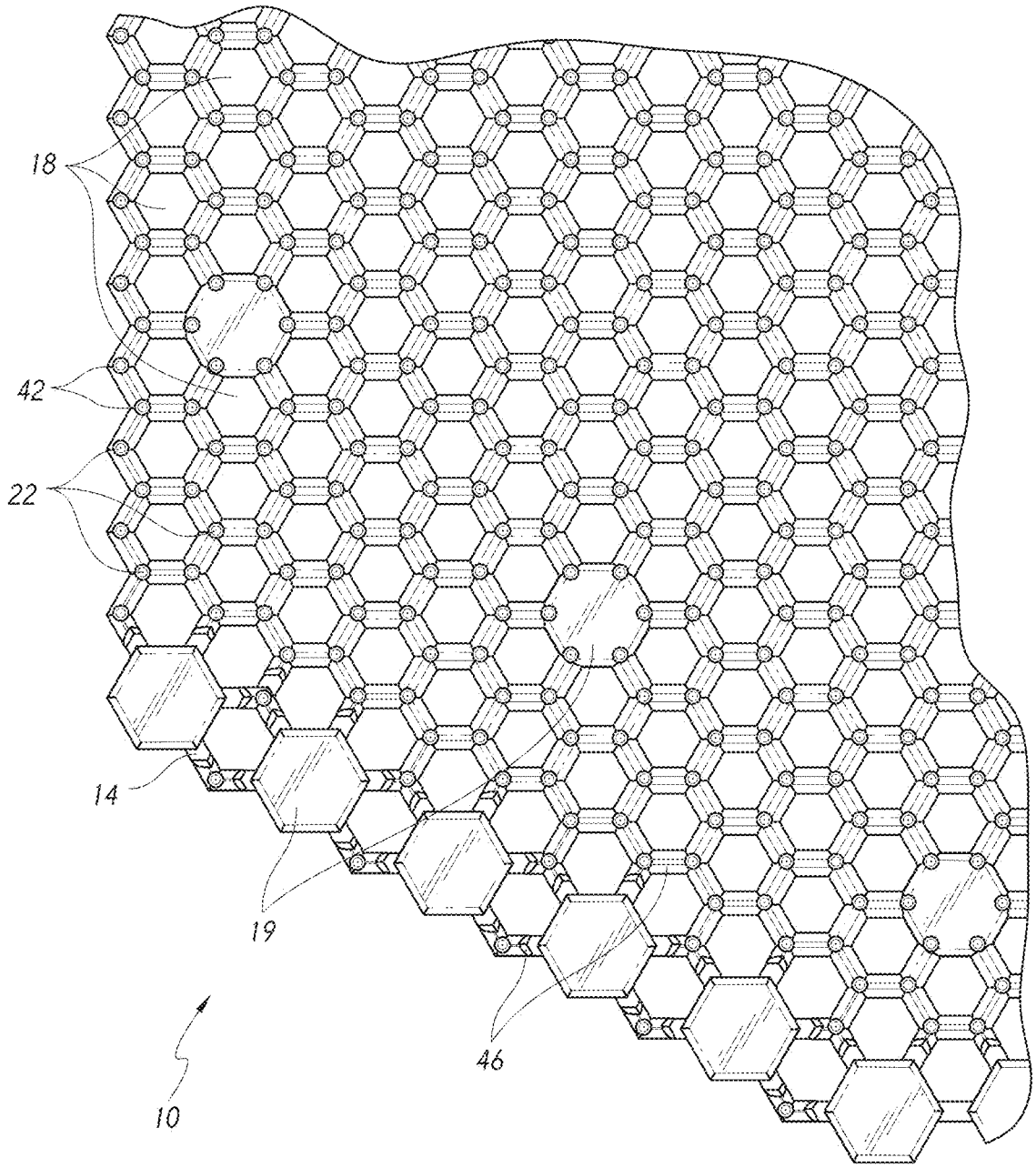
FIG. 3 is a front view of the urinal screen of FIG. 1.

As illustrated in FIGS. 2 and 3, one or more of the openings 18 (e.g., cells) can have a perimeter which includes a plurality of sides (e.g., braces) 42 and corners 46. In some cases, all or a portion of the frame 14 forms a tessellation of openings 18 wherein a plurality of the sides 42 of the openings 18 are shared between two or more openings 18. In some embodiments, each of the openings 18 shares at least one side and at least one corner with another opening.

In some cases, the sides 42 and/or corners 46 of the openings 18 have contoured (e.g., convex) upper and/or lower surfaces. The contoured surfaces of the sides 42 and corners 46 can deflect fluid (e.g., urine) to reduce splash in the urinal, toilet, or other environment in which the urinal screen 10 is installed.

In some embodiments, as illustrated in FIGS. 1 and 2, portions of the frame 14 include one or more solid or closed portions between or surrounding the openings 18. For example, the frame 14 can include one or more solid cells 19 positioned between and/or adjacent the openings 18 of the frame 14. The solid cells 19 can provide a surface area on which various letters, numbers, symbols, trademarks, and/or other visual features may be placed. For example, advertisements, installation instructions, date features, expiration dates, and/or other features may be included on the solid cells 19. In some embodiments, the frame 14 includes one or more intermediate solid cells 20 and/or large solid cells 15 for placement of larger/more complex visual features. For example, the intermediate solid cells 20 can occupy an area greater than or equal to 2, 3, 4, 5, and/or 6 openings 18. In some embodiments, the large solid cell 15 can occupy an area greater than or equal to 10 openings 18. Many variations are possible. In some embodiments, the one or more solid or closed portions facilitate easier removal of the screen 10 from a mold. In some cases, utilizing solid portions increases an amount of fragrance that can be embedded, coated, injected, or otherwise associated with the screen 10.

Figure 4:
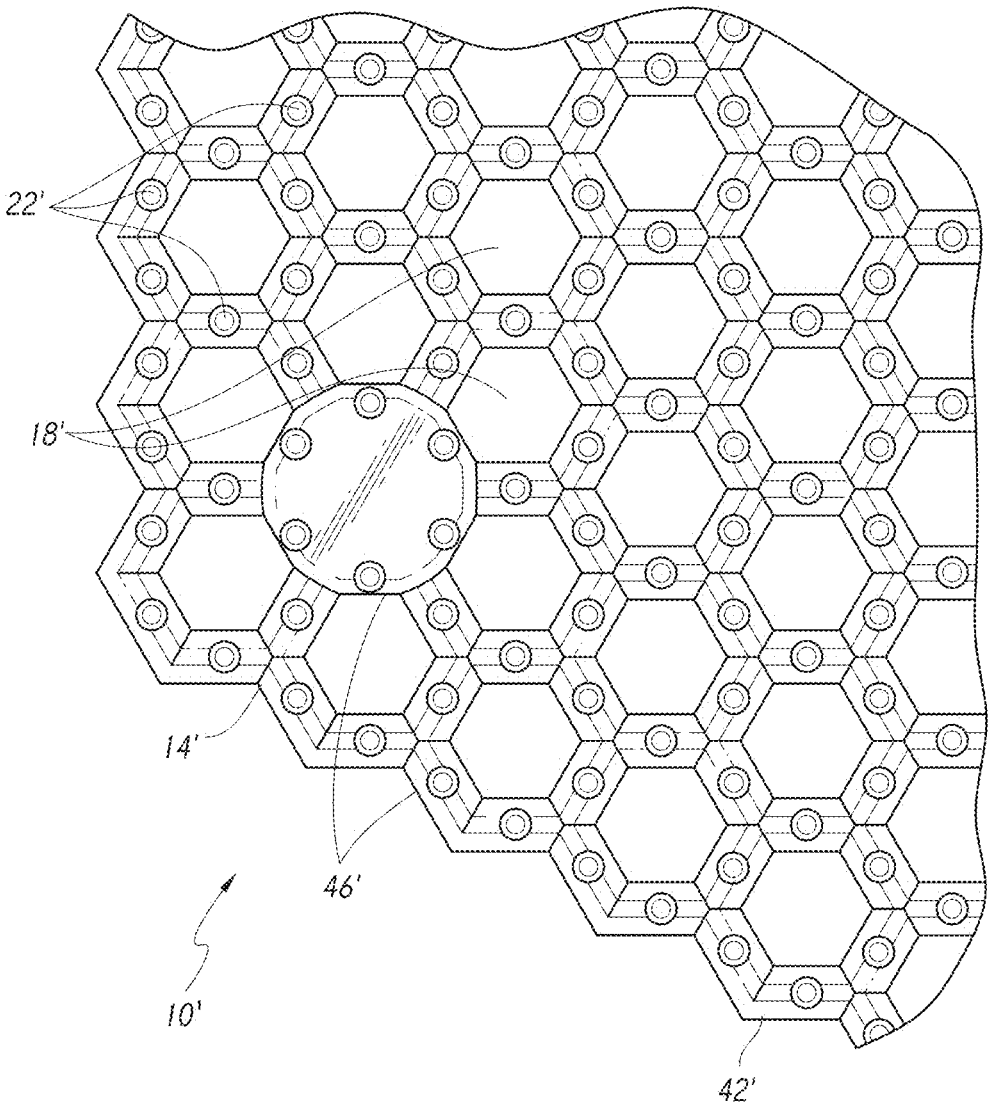
FIG. 4 is a close up top view of the urinal screen of FIG. 1.

In some embodiments, the posts 22 extend from the corners 46 of the frame forming openings 18. FIG. 4 illustrates an embodiment of a screen 10' wherein the posts 22' extend from the sides 42' (e.g., the midpoints of the sides 42') of the portions of the frame forming the openings 18' of the frame 14'. In some embodiments, posts 22 extend from both the portions of the fame forming the corners 46 and the portions of the frame forming the sides 42 or from some combination thereof. In some embodiments, posts 22 extend from the portions of the frame forming the corners 46 of the openings 18 on one side of the frame 14 (e.g., the first side 26, as shown in FIG. 5) and from the portions of the frame forming the sides 42 of the openings 18 on the other side of the frame 14 (e.g., the second side 30).

Figure 5:
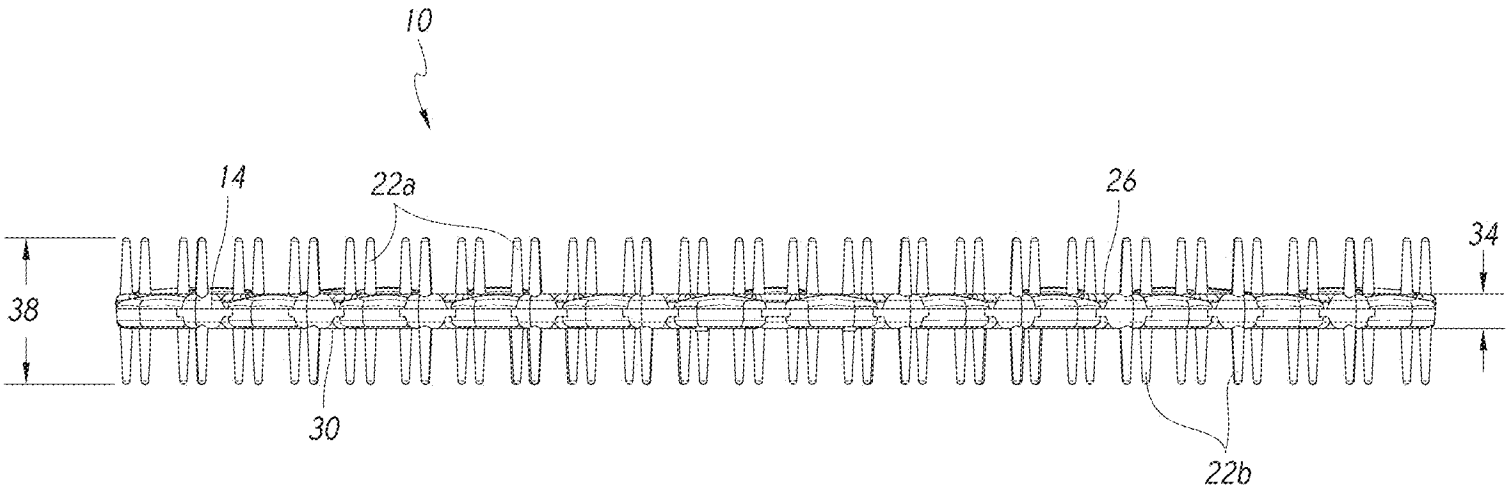
FIG. 5 is a close up top view of another embodiment of a urinal screen.

As illustrated in FIG. 5, the posts 22 can extend from a first surface 26 of the frame 14. In some embodiments, posts 22 extend from both the first surface 26 of the frame 14 and a second surface 30 of the frame 14. For example, a first plurality of posts 22*a* can extend from the first surface 26 of the frame 14 and a second plurality of posts 22*b* can extend from the second surface 30 of the frame 14. Each of the posts in the first plurality of posts 22*a* can be substantially identical to the each of the posts in the second plurality of posts 22*b*. For example, each of the posts can have the same height, width and/or overall shape.

Figure 6:
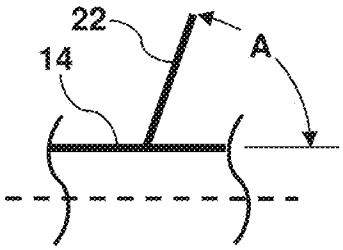
FIG. 6 is a schematic side view of a post extending from a frame of a urinal screen at a non-perpendicular angle.

In some embodiments, at least half, at least ¾, at least ⅕, at least ⅔, at least ⅓, at least 9/10, at least ⅘ and/or at least 1/10 of the first plurality of posts 22*a* have a same size and shape as at least half, at least ¾, at least ⅕, at least ⅔, at least ⅓, at least 9/10, at least ⅘ and/or at least 1/10 of the second plurality of posts 22*b*. In some embodiments, one or more of the posts in the first plurality of posts 22*a* has a different shape and/or height than one or more of the posts in the second plurality of posts 22*b*. In some embodiments, the first plurality of posts 22*a* and/or the second plurality of posts 22*b* have a plurality of heights. For example, a percentage (e.g., 25%, 50%, 75% or some other percentage) of the posts 22 can be shorter than the remaining posts as measured from the first or second surfaces 26, 30 of the frame 14. In some embodiments, at least ⅘, at least ⅗, at least ½, and/or at least ¼ of the posts 22 have a height differing from the remaining posts 22. In some embodiments, one or more of the posts 22 is at least ⅕, at least 1/10, at least ⅛, at least ¼, and/or at least ⅓ shorter than one or more of the other posts 22. In some cases, each post is at least ⅕ shorter, at least 1/10 shorter, at least ⅛ shorter, at least ¼ shorter, at least ⅓ shorter, at least ½ taller, at least ¼ taller, at least ⅛ taller, at least 1/10 taller, and/or at least 1/16 taller than at least one of the 3 closest posts 22, at least one of the 5 closest posts 22, at least one of the 7 closest posts 22, at least one of the 9 closest posts 22, at least one of the 10 closest posts 22, at least one of the 12 closest posts 22, and/or at least one of the 15 closest posts 22. In some embodiments, shortening a percentage of the posts 22 can reduce the likelihood that debris is caught in the urinal screen 10. The posts 22 can extend perpendicularly from the frame 14 (e.g., from the first or second surfaces 26, 30 of the frame 14). In some embodiments, one or more of the posts 22 extends from the frame 14 at a non-perpendicular angle (for example, non-perpendicular angle A of FIG. 6).

The frame 14 can have a generally planar or flat shape. In some embodiments, the frame 14 is curved or otherwise shaped in non-planar fashion. For example, the frame 14 can be molded in a non-planar shape to match the contours of a urinal or toilet.

The frame 14 can have a frame thickness 34 (e.g., a distance between the first and second surfaces 26, 30 of the frame 14). The frame thickness 34 can be uniform across the entire frame 14 or can vary in certain portions of the frame 14. An overall thickness 38 of the urinal screen 10 can be measured from a tip of the tallest post 22 extending from the first surface 26 of the frame 14 to a tip of the tallest post 22 extending from the second surface 30 of the fame 14 as measured perpendicularly from the first and second surfaces 26, 30. In some cases, wherein the frame 14 is not planar/flat, the overall thickness 38 of the urinal screen 10 can be determined via the tips of the posts 22 as measured perpendicularly to a tangent plane of the first surface 26 of the frame 14 at a point on the frame 14 where the thicknesses 34, 38 are being measured.

In some embodiments, the frame thickness 34 at a given position on the frame 14 is less than or equal to approximately ½ of the overall screen thickness 38 as measured perpendicularly to the first surface 26 of the frame 14 at the given position. In some embodiments, the frame thickness 34 is less than or equal to ⅔, less than or equal to ⅝, less than or equal to ⅜, less than or equal to ⅓, less than or equal to ¼, less than or equal to ⅖, less than or equal to ⅛, less than or equal to 1/10, less than or equal to 1/16, and/or less than or equal to 1/32 of the overall screen thickness 38. Use of a thin frame 14 can reduce the overall weight of the urinal screen 10.

In some embodiments, the urinal screen 10 is configured such that a plurality of posts 22 space the frame 14 from the installation surface of a urinal or other fixture onto which the urinal screen 10 is installed. The posts 22 space the frame 14 from the installation surface independent from the orientation of the urinal screen 10. For example, the second plurality of posts 22*b* can form a base of the urinal screen 10 and can space the frame 14 from the installation surface when the screen 10 is installed with the second surface 30 of the frame 14 facing the installation surface. On the other hand, the first plurality of posts 22*a* can form a base of the urinal screen 10 and can space the frame 14 from the installation surface when the screen 10 is installed with the first surface 26 of the frame facing the installation surface. In some embodiments, the posts 22 space the frame 14 from the installation surface by at least ⅓ of the overall thickness 38 of the urinal screen 10. In some embodiments, the posts 22 space the frame 14 from the installation surface by at least ⅛, at least ⅐, at least ⅙, at least ⅕, at least ¼, at least ⅜, and/or by at least ⅘ of the overall thickness 38 of the urinal screen 10.

Spacing the frame 14 from the installation surface can reduce the likelihood that the openings 18 are clogged by debris. In some embodiments, the posts 22 positioned between the frame 14 and the installation surface can reduce splashing in the urinal by deflecting urine or other fluids which pass between the frame 14 and the installation surface (e.g., fluid that passes through the openings 18 or around the perimeter of the frame 14).

For expository purposes, the term "horizontal" as used herein is defined as a plane parallel to the plane or surface of the floor of the area in which the system being described is used or the method being described is performed, regardless of its orientation. The term "floor" floor can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

As used herein, the terms "attached," "connected," "mated," and other such relational terms should be construed, unless otherwise noted, to include removable, moveable, fixed, adjustable, and/or releasable connections or attachments. The connections/attachments can include direct connections and/or connections having intermediate structure between the two components discussed.

The terms "approximately", "about", "generally" and "substantially" as used herein represent an amount close to the stated amount that still performs a desired function or achieves a desired result. For example, the terms "approximately", "about", "generally," and "substantially" may refer to an amount that is within less than 10% of the stated amount.

While the preferred embodiments of the present inventions have been described above, it should be understood that they have been presented by way of example only, and not of limitation. It will be apparent to persons skilled in the relevant art that various changes in form and detail can be made therein without departing from the spirit and scope of the inventions. Thus the present inventions should not be limited by the above-described exemplary embodiments, but should be defined only in accordance with the following claims and their equivalents. Furthermore, while certain advantages of the inventions have been described herein, it is to be understood that not necessarily all such advantages may be achieved in accordance with any particular embodiment of the inventions. Thus, for example, those skilled in the art will recognize that the inventions may be embodied or carried out in a manner that achieves or optimizes one advantage or group of advantages as taught herein without necessarily achieving other advantages as may be taught or suggested herein.

What is claimed is:

1. A fragrant device for restrooms, the fragrant device comprising:

a fragranced flexible polymer material that forms a screen for use in a urinal and through which urine can pass, wherein the screen comprises a plurality of braces that at least partially define a plurality of openings through the screen for urine to pass therethrough, wherein, for each brace of at least a majority of the plurality of braces, the brace at least partially defines more than one opening of the plurality of openings, wherein the screen further comprises a plurality of protrusions extending above and below the plurality of braces such that the plurality of braces can be supported above a urinal surface by at least a portion of the plurality of protrusions, wherein the screen is adapted to be reversed such that either of a first side of the screen or a second side of the screen is usable as a top side or a bottom side with the plurality of braces supported above the urinal surface, wherein the plurality of protrusions are configured such that the plurality of braces will be supported above the urinal surface by a distance that is at least ¼ of an overall thickness of the screen with the first side of the screen used as either the top side or the bottom side, wherein, for each protrusion of at least a majority of the plurality of protrusions, the protrusion extends from an intersection of braces of the plurality of braces, and wherein the plurality of openings occupy more than ¼ of an overall surface area of the screen as observed perpendicular to a flat surface when the screen is set on the flat surface.

2. The fragrant device of claim 1, wherein, for each opening of at least a majority of the plurality of openings, a protrusion of the plurality of protrusions extends from each intersection of braces that at least partially define that opening.

3. The fragrant device of claim 1, wherein, for each opening of at least a majority of the plurality of openings, six protrusions of the plurality of protrusions extend from intersections of braces that at least partially define that opening.

4. The fragrant device of claim 1, wherein, for each protrusion of at least a majority of the plurality of protrusions, the protrusion extends from an intersection of three braces of the plurality of braces.

5. The fragrant device of claim 4, wherein the three braces comprise:

a first brace that at least partially defines a first opening of the plurality of openings and a second opening of the plurality of openings;

a second brace that at least partially defines the first opening of the plurality of openings and a third opening of the plurality of openings; and a third brace that at least partially defines the second opening of the plurality of openings and the third opening of the plurality of openings.

6. The fragrant device of claim 1, wherein at least a majority of the plurality of openings form a pattern of openings comprising a covering of a geometric plane without gaps or overlaps by congruent plane figures of one type or a few types.

7. A fragrant device for restrooms, the fragrant device comprising:

a fragranced flexible polymer material that forms a screen for use in a urinal and through which urine can pass, wherein the screen comprises a plurality of openings through the screen for urine to pass therethrough, a plurality of perimeter structures, and a plurality of protrusions, wherein, for each opening of at least a majority of the plurality of openings:

a perimeter of the opening is at least partially formed by a plurality of the plurality of perimeter structures that each comprise a non-planar upper surface and a non-planar lower surface and that each at least partially form a perimeter of another opening of the plurality of openings, and a plurality of the plurality of protrusions are connected to and extend above and below the plurality of the plurality of perimeter structures, wherein the plurality of protrusions are configured such that the plurality of perimeter structures can be supported above a urinal surface by at least a portion of the plurality of protrusions, wherein the screen is adapted to be reversed such that either of a first side of the screen or a second side of the screen is usable as a top side or a bottom side with the plurality of perimeter structures supported above the urinal surface, wherein the plurality of protrusions are configured such that the plurality of perimeter structures will be supported above the urinal surface by a distance that is at least ¼ of an overall thickness of the screen with the first side of the screen used as either the top side or the bottom side, and wherein the plurality of openings occupy more than ¼ of an overall surface area of the screen as observed perpendicular to a flat surface when the screen is set on the flat surface.

8. The fragrant device of claim 7, wherein each protrusion of at least a majority of the plurality of protrusions comprises a tapered shape that is narrower at a tip than at a location where the protrusion connects to a perimeter structure of the plurality of perimeter structures.

9. The fragrant device of claim 7, wherein, for each opening of at least a majority of the plurality of openings, at least some protrusions of the plurality of protrusions are connected to a perimeter structure at a location between intersections of perimeter structures.

10. The fragrant device of claim 7, wherein, for each opening of at least a majority of the plurality of openings, at least some protrusions of the plurality of protrusions are connected to a perimeter structure at a location between intersections of perimeter structures.

* * * * *